US006562224B2

(12) United States Patent
Crottaz et al.

(10) Patent No.: US 6,562,224 B2
(45) Date of Patent: May 13, 2003

(54) NICKEL-IRON ALLOY-BASED ANODES FOR ALUMINIUM ELECTROWINNING CELLS

(75) Inventors: Olivier Crottaz, Petit-Lancy (CH); Jean-Jacques Duruz, Geneva (CH)

(73) Assignee: Moltech Invent S.A. (LU)

( * ) Notice: Subject to any disclaimer, the term of this patent is extended or adjusted under 35 U.S.C. 154(b) by 0 days.

(21) Appl. No.: 09/772,283

(22) Filed: Jan. 29, 2001

(65) Prior Publication Data

US 2001/0022274 A1 Sep. 20, 2001

Related U.S. Application Data

(63) Continuation of application No. PCT/IB99/01362, filed on Jul. 30, 1999.

(51) Int. Cl.[7] ..... C25C 3/08

(52) U.S. Cl. ..... 205/384; 205/385; 205/387; 205/394; 205/380

(58) Field of Search ..... 205/380, 384, 205/385, 387, 394; 204/247.3, 291

(56) References Cited

U.S. PATENT DOCUMENTS 6,077,415 A * 6/2000 Duruz et al. ..... 205/384

* cited by examiner

*Primary Examiner*—Bruce F. Bell
(74) *Attorney, Agent, or Firm*—Jayadeep R. Deshmukh

(57) ABSTRACT

A method of manufacturing an anode for use in a cell for the electrowinning of aluminium comprises oxidising before cell operation an iron-nickel alloy substrate in an oxygen-containing atmosphere, such as air, at a temperature which is at least 50° C., preferably 100° C., above the operating temperature of the cell to form on the surface of the iron-nickel substrate a coherent and adherent iron oxide-containing outer layer, in particular a hematite-containing layer having a limited ionic conductivity for oxygen ions and acting as a partial barrier to monoatomic oxygen. The outer layer is electrochemically active for the oxidation of oxygen ions and reduces also diffusion of oxygen to the iron-nickel alloy substrate when the anode is in use.

22 Claims, No Drawings

NICKEL-IRON ALLOY-BASED ANODES FOR ALUMINIUM ELECTROWINNING CELLS

This application is a continuation of the U.S. designation of PCT/IB99/01362 filed on Jul. 30, 1999.

FIELD OF THE INVENTION

This invention relates to a method for producing non-carbon, metal-based, anodes for use in cells for the electrowinning of aluminium by the electrolysis of alumina dissolved in a fluoride-containing molten electrolyte, and their use to produce aluminium.

BACKGROUND ART

The technology for the production of aluminium by the electrolysis of alumina, dissolved in molten cryolite, at temperatures around 950° C. is more than one hundred years old.

This process, conceived almost simultaneously by Hall and Héroult, has not evolved as many other electrochemical processes.

The anodes are still made of carbonaceous material and must be replaced every few weeks. During electrolysis the oxygen which should evolve on the anode surface combines with the carbon to form polluting $CO_2$ and small amounts of CO and fluorine-containing dangerous gases. The actual consumption of the anode is as much as 450 Kg/Ton of aluminium produced which is more than ⅓ higher than the theoretical amount of 333 Kg/Ton.

Using metal anodes in aluminium electrowinning cells would drastically improve the aluminium process by reducing pollution and the costs of aluminium production.

U.S. Pat. No. 4,614,569 (Duruz/Derivaz/Debely/Adorian) describes anodes for aluminium electrowinning coated with a protective coating of cerium oxyfluoride, formed in-situ in the cell or pre-applied, this coating being maintained by the addition of cerium to the molten cryolite electrolyte. This made it possible to have a protection of the surface only from the electrolyte attack and to a certain extent from the gaseous oxygen but not from the nascent monoatomic oxygen.

EP Patent application 0,306,100 (Nyguen/Lazouni/Doan) describes anodes composed of a chromium, nickel, cobalt and/or iron based substrate covered with an oxygen barrier layer and a ceramic coating of nickel, copper and/or manganese oxide which may be further covered with an in-situ formed protective cerium oxyfluoride layer.

Likewise, U.S. Pat. Nos. 5,069,771, 4,960,494 and 4,956,068 (all Nyguen/Lazouni/Doan) disclose aluminium production anodes with an oxidised copper-nickel surface on an alloy substrate with a protective oxygen barrier layer. However, full protection of the alloy substrate was difficult to achieve.

Metal or metal-based anodes are highly desirable in aluminium electrowinning cells instead of carbon-based anodes. As mentioned hereabove, many attempts were made to use metallic anodes for aluminium production, however they were never adopted by the aluminium industry.

OBJECTS OF THE INVENTION

A major object of the invention is to provide a method for manufacturing an anode for aluminium electrowinning which has no carbon so as to eliminate carbon-generated pollution and increase the anode life.

A further object of the invention is to provide a method for manufacturing an aluminium electrowinning anode with a surface having a high electrochemical activity for the oxidation of oxygen ions for the formation and evolution of bimolecular gaseous oxygen and a low solubility in the electrolyte.

Another object of the invention is to provide a method for manufacturing an anode for the electrowinning of aluminium which is covered with an electrochemically active layer with limited ionic conductivity for oxygen ions and at least a limited barrier to monoatomic oxygen.

Yet another object of the invention is to provide a method for manufacturing an anode for the electrowinning of aluminium which is made of readily available material(s).

SUMMARY OF THE INVENTION

The invention relates to a method of manufacturing an anode for use in a cell for the electrowinning of aluminium by the electrolysis of alumina dissolved in a fluoride-containing molten electrolyte, such as cryolite, at an operating temperature in the range of 700° to 970° C., preferably between 820° and 870° C. The anode comprises an iron-nickel alloy substrate.

A suitable electrolyte at a temperature of 820° to 870° C. may typically contain 23 to 26.5 weight % $AlF_3$, 3 to 5 weight % $Al_2O_3$, 1 to 2 weight % LiF and 1 to 2 weight % $MgF_2$.

According to the invention, the method comprises, before use in an electrolyte at an operating temperature in the above mentioned range, oxidising the iron-nickel alloy substrate in an oxygen-containing atmosphere at a temperature (hereinafter called the "oxidation temperature") which is at least 50° C. above the operating temperature of the electrolyte to form on the surface of the iron-nickel substrate a coherent and adherent iron oxide-containing outer layer having a limited ionic conductivity for oxygen ions and acting as a partial barrier to monoatomic oxygen. The outer layer is electrochemically active for the oxidation of oxygen ions and reduces also diffusion of oxygen into the iron-nickel alloy substrate when the anode is in use.

The iron oxide-containing outer layer may be a hematite-containing layer. At greater nickel concentration in the iron-nickel substrate, the iron oxide-containing outer layer may also contain nickel oxides, mainly nickel ferrite, in addition to iron oxide.

It has been observed that iron oxides and in particular hematite ($Fe_2O_3$) have a higher solubility than nickel and other metals in fluoride-containing molten electrolyte. However, in commercial production the contamination tolerance of the product aluminium by iron oxides is also much higher (up to 2000 ppm) than for other metal impurities.

Solubility is an intrinsic property of anode materials and cannot be changed otherwise than by modifying the electrolyte composition and/or the operating temperature of a cell.

Laboratory scale cell tests utilising a $NiFe_2O_4$/Cu cermet anode and operating under steady conditions were carried out to establish the concentration of iron in molten electrolyte and in the product aluminium under different operating conditions.

In the case of iron oxide, it has been found that lowering the temperature of the electrolyte decreases drastically the solubility of iron species. This effect can surprisingly be exploited to produce a major impact on cell operation by limiting the contamination of the product aluminium by iron.

Thus, it has been found that when the temperature of aluminium electrowinning cells is reduced below the temperature of conventional cells an anode provided with an outer layer of iron oxide which is obtained by the method of this invention can be made dimensionally stable by maintaining a concentration of iron species in the molten electrolyte sufficient to suppress the dissolution of the electrochemically active iron oxide anode surface obtained by the method of the invention but low enough not to exceed the commercially acceptable level of iron in the product aluminium.

DETAILED DESCRIPTION

As stated above, the method of the invention comprises oxidising, before use in an electrolyte of an aluminium electrowinning cell, the iron-nickel alloy substrate in an oxygen-containing atmosphere at an oxidation temperature which is at least 50° C. above the operating temperature of the electrolyte.

However, the oxidation temperature can be 100° C. or more above the cell operating temperature, in particular 150° to 250° C. above. Usually, the oxidation temperature is below 1250° C. The oxidation temperature may for instance be from 950° to 1150° C., in particular from 1000° to 1100° C.

The oxidation period of the iron-nickel alloy substrate before use in an electrolyte may last 5 to 100 hours, in particular 20 to 75 hours.

The iron-nickel alloy may be oxidised in an oxygen-containing atmosphere having an oxygen-content between 10 to 100 weight %. For instance, the oxygen-containing atmosphere may be air.

The iron-nickel alloy substrate may comprise 30 to 95 weight % iron and 5 to 70 weight % nickel, in particular 40 to 80 weight % iron and 20 to 60 weight % nickel, for instance 50 to 70 weight % iron and 30 to 50 weight % nickel, i.e. with optionally up to 65 weight % of further constituents providing it is still capable of forming an iron oxide-based electrochemically active layer. Normally, the iron-nickel alloy comprises less than 40 weight %, in particular less than 20 weight % and often less than 10 weight %, of further constituents. Such constituents may be added to improve the mechanical and/or electrical properties of the anode substrate, and/or the adherence, the electrical conductivity and/or the electrochemical activity of the anode layer.

The iron-nickel alloy substrate may in particular comprise in addition to iron and nickel the following constituents in the given proportions: up to 15 weight % of chromium and/or additional alloying metals selected from titanium, copper, molybdenum, aluminium, hafnium, manganese, niobium, silicon, tantalum, tungsten, vanadium, yttrium and zirconium, in a total amount of up to 5 weight %. Furthermore, nickel present in the iron-nickel alloy substrate may be partly substituted with cobalt. The iron-nickel alloy substrate may contain up to 30 weight % of cobalt.

The invention also relates to a method of preparing an anode and operating it in an aluminium electrowinning cell which comprises at least one cathode and contains alumina dissolved in a molten electrolyte. The method comprises manufacturing an anode in an oxygen-containing atmosphere at a temperature which is at least 50° C. above the operating temperature of the molten electrolyte as defined above, transferring the anode into the molten electrolyte contained in the aluminium electrowinning cell, and passing an ionic current from the anode to the cathode so that the alumina dissolved in the molten electrolyte is electrolysed to produce oxygen on the anode and aluminium on the cathode.

To avoid thermal shocks, the anode may be transferred into the molten electrolyte without cooling the anode below the temperature of the molten electrolyte.

During cell operation, the anode may be kept dimensionally stable in the molten electrolyte by maintaining a sufficient amount of dissolved alumina and iron species in the molten electrolyte to prevent dissolution of the iron oxide-containing outer layer.

As discussed above the cell may advantageously be operated at a sufficiently low temperature to limit the solubility of the iron oxide-containing outer layer, thereby limiting the contamination of the product aluminium by constituents of the iron oxide-containing outer layer.

The invention will be further described in the following Examples:

EXAMPLE 1

An anode was prepared according to the invention by oxidising an iron-nickel anode substrate consisting of 64 weight % iron and 36 weight % nickel in air at 1100° C. for 48 hours in a furnace to form an iron oxide layer on the substrate.

Upon oxidation, the anode was extracted from the furnace and underwent a microscope examination. The anode substrate was covered with a coherent hematite oxide layer which is electrochemically active for the oxidation of oxygen ions.

EXAMPLE 2

An anode was oxidised as in Example 1 and then immediately (without cooling) tested in a cell for the electrowinning of aluminium. The cell contained a molten electrolyte at 850° C. consisting of 70 weight % cryolite, 26 weight % aluminium fluoride and 4 weight % alumina for 72 hours at a current density of 0.6 A/cm$^2$.

The anode was then extracted and examined. The anode showed no significant sign of dissolution or corrosion.

EXAMPLE 3

An anode was oxidised as in Example 1 and then used in a cell for the electrowinning of aluminium as described in Example 2.

During electrolysis, iron species from the electrolyte which had been reduced into the product aluminium were periodically compensated by adding iron oxide powder together with alumina to the electrolyte. The periodic compensation of iron species maintained a sufficient concentration of iron oxide in the electrolyte (near to saturation) to effectively inhibit dissolution of the iron oxide outer anode layer.

After 72 hours, the anode was extracted from the electrolyte and examined. The anode showed no visible sign of dissolution or corrosion.

EXAMPLE 4

Another anode was prepared according to the invention by oxidising an iron-nickel anode substrate consisting of 40 weight % iron and 60 weight % nickel in air at 1150° C. for 72 hours in a furnace to form an electrochemically active oxide layer on the substrate.

Upon oxidation, the anode was extracted and underwent a microscope examination. The electrochemically active oxide layer of the anode was coherent and adherent to the anode substrate.

Anodes similarly prepared were tested under similar cell conditions as described in Examples 2 and 3 and showed similar results.

What is claimed is:

1. A method of manufacturing an anode for use in a cell for the electrowinning of aluminium by the electrolysis of alumina dissolved in a fluoride-containing molten electrolyte at an operating temperature in the range of 700° to 970° C., the anode comprising an iron-nickel alloy substrate, the method comprising before use in an electrolyte at an operating temperature in said range oxidising the iron-nickel alloy substrate in an oxygen-containing atmosphere at a temperature (hereinafter called the "oxidation temperature") which is at least 50° C. above said operating temperature to form on the surface of the iron-nickel substrate a coherent and adherent iron oxide-containing outer layer having a limited ionic conductivity for oxygen ions and acting as a partial barrier to monoatomic oxygen, the outer layer being electrochemically active for the oxidation of oxygen ions and reducing also diffusion of oxygen into the iron-nickel alloy substrate when the anode is in use.

2. The method of claim 1, wherein the iron oxide-containing outer layer is a hematite-containing layer.

3. The method of claim 1, wherein the iron oxide-containing outer layer contains iron oxide and nickel ferrite.

4. The method of claim 1, wherein the oxidation temperature is at least 100° C. above said operating temperature.

5. The method of claim 1, wherein the oxidation temperature is below 1250° C.

6. The method of claim 1, wherein the oxidation temperature is from 950° to 1150° C.

7. The method of claim 6, wherein the oxidation temperature is comprised from 1000° to 1100° C.

8. The method of claim 1, comprising oxidising the iron-nickel alloy substrate for 5 to 100 hours before use in an electrolyte.

9. The method of claim 8, comprising oxidising the iron-nickel alloy substrate for 20 to 75 hours before use in an electrolyte.

10. The method of claim 1, wherein the oxygen-containing atmosphere has an oxygen-content from 10 to 100 weight %.

11. The method of claim 10, wherein the oxygen-containing atmosphere is air.

12. The method of claim 1, wherein the iron-nickel alloy substrate comprises 30 to 95 weight % iron and 5 to 70 weight % nickel.

13. The method of claim 12, wherein the iron-nickel alloy substrate comprises 40 to 80 weight % iron and 20 to 60 weight % nickel.

14. The method of claim 13, wherein the iron-nickel alloy substrate comprises 50 to 70 weight % iron and 30 to 50 weight % nickel.

15. The method of claim 12, wherein the nickel of the iron-nickel alloy substrate is partly substituted with cobalt.

16. The method of claim 15, wherein the iron-nickel alloy substrate comprises up to 30 weight % cobalt.

17. The method of claim 1, wherein the iron-nickel alloy substrate comprises up to 15 weight % chromium.

18. The method of claim 1, wherein the iron-nickel alloy substrate comprises one or more additional alloying metals selected from titanium, copper, molybdenum, aluminium, hafnium, manganese, niobium, silicon, tantalum, tungsten, vanadium, yttrium and zirconium, in a total amount of up to 5 weight %.

19. A method of preparing an anode and operating it in an aluminium electrowinning cell which comprises at least one cathode and contains alumina dissolved in a molten electrolyte, the method comprising manufacturing an anode in an oxygen-containing atmosphere at a temperature which is at least 50° C. above the operating temperature of the molten electrolyte as defined in claim 1, transferring the anode into the molten electrolyte contained in the aluminium electrowinning cell, and passing an ionic current from the anode to the cathode so that the alumina dissolved in the molten electrolyte is electrolysed to produce oxygen on the anode and aluminium on the cathode.

20. The method of claim 19, comprising transferring the anode into the molten electrolyte without cooling the anode below the temperature of the molten electrolyte.

21. The method of claim 19, comprising keeping the anode dimensionally stable in the molten electrolyte by maintaining a sufficient amount of dissolved alumina and iron species in the molten electrolyte to prevent dissolution of the iron oxide-containing outer layer.

22. The method of claim 19, comprising operating the cell at a sufficiently low temperature to limit the solubility of the iron oxide-containing outer layer, thereby limiting the contamination of the product aluminium by constituents of the iron oxide-containing outer layer.

* * * * *